United States Patent [19]

Chiyoda et al.

[11] 4,265,603

[45] May 5, 1981

[54] REFRIGERANT COMPRESSOR FOR AIR CONDITIONING OF VEHICLES

[75] Inventors: Tsuneyuki Chiyoda; Masami Ohtani, both of Higashi-Matsuyama, Japan

[73] Assignee: Diesel Kiki Co. Ltd., Tokyo, Japan

[21] Appl. No.: 28,890

[22] Filed: Apr. 10, 1979

[30] Foreign Application Priority Data

Apr. 28, 1978 [JP] Japan ..... 53/56235[U]

[51] Int. Cl.[3] ..... F04C 15/04

[52] U.S. Cl. ..... 418/2; 73/343 R; 340/585; 340/648; 340/682; 417/63

[58] Field of Search ..... 418/2; 417/63; 91/1; 92/5 R; 62/127; 73/343 R, 362 AR, 362 SC; 340/581, 584, 585, 648, 679, 682

[56] References Cited

U.S. PATENT DOCUMENTS

| | | | |
|---|---|---|---|
| 2,221,874 | 11/1940 | Kuzmann | 418/2 X |
| 3,081,631 | 3/1963 | Switzer, Jr. et al. | 73/343 R |
| 3,281,518 | 10/1966 | Stroud et al. | 73/343 R X |
| 3,824,579 | 7/1974 | Waseleski, Jr. et al. | 340/682 X |
| 3,834,846 | 9/1974 | Linder et al. | 418/255 |
| 4,074,575 | 2/1978 | Bergman et al. | 340/682 X |

FOREIGN PATENT DOCUMENTS

| | | | |
|---|---|---|---|
| 2311770 | 9/1974 | Fed. Rep. of Germany | 418/2 |
| 1436836 | 5/1976 | United Kingdom | 418/2 |

*Primary Examiner*—Philip R. Coe

*Attorney, Agent, or Firm*—Frishauf, Holtz, Goodman & Woodward

[57] ABSTRACT

A refrigerant compressor for use with an air conditioner for vehicles, which comprises a housing in which a vane pump is accommodated, and a covering disposed so as to enclose said housing in a fashion that its inner wall cooperates with the outer wall of said housing to define a refrigerant delivery chamber, characterized by that a temperature sensor is embedded in a portion of the outer wall of said housing. The sensor may be composed of a semiconductor thermo-sensitive device or a conductor wire made of a metal including a high resistance metal. Thus, accurate and stable detection of the internal temperature of the compressor is feasible, thereby making it possible to avoid seizure of the sliding machine parts of the compressor.

13 Claims, 6 Drawing Figures

REFRIGERANT COMPRESSOR FOR AIR CONDITIONING OF VEHICLES

FIELD OF THE INVENTION

The present invention relates to a refrigerant compressor for use in an air conditioner for vehicles, and more particularly to a refrigerant temperature detecting device provided in such refrigerant compressor.

A vane-type refrigerant compressor for use in an air conditioner for vehicles is already known, e.g. from U.S. Pat. No. 3,834,846 issued Sept. 10, 1974, which is of the type comprising: a refregerant intake port; a refreigerant delivery port; a rotary shaft arranged to be rotated by an associated engine; a rotor secured to said rotary shaft for rotation therewith, the rotor having a plurality of slits formed in an outer peripheral surface thereof; a plurality of vanes radially movably inserted in said slits; a housing accommodating said rotor and said vanes, the rotor, the vanes and the housing cooperating to define pump working chambers between them; and a covering arranged in a fashion enclosing said housing, the covering having an inner peripheral wall thereof cooperating with an outer peripheral wall of said housing to define a refregerant delivery chamber which is in communication with both the interior of the housing and said refregerant delivery port.

However, such conventional refrigerant compressor sometimes underwent overheating when there occurred a shortage of refrigerant or lubrication oil circulating in the compressor, or when the air conditioner was heavily loaded, which often brought about the phenomenon that the sliding machine parts of the compressor cohere to each other or seize through excessive temperature. Therefore, most of the conventional compressors are provided with some anti-overheating measures.

Prevention of overheating of the conventional refrigerant compressor was carried out by mounting a temperature limit switch such as a thermal relay on the outer peripheral surface of the compressor covering which forms the outer frame of the compressor, the inner wall of which defines a refrigerant delivery chamber, detecting the temperature of the refrigerant in said refrigerant delivery chamber via said covering by means of said limit switch, and controlling the quantity of refrigerant flowing in the commpressor in response to the detected temperature value.

The above-mentioned system that the overheated state of the compressor is detected by such temperature limit switch in an indirect manner in terms of the temperature of refrigerant being delivered, and that, through the compressor covering, is not sufficient for accurate detection of the overheated state of the compressor. Therefore, to ensure prevention of the seizure of the sliding machine parts of the compressor due to overheating, the preset temperature at which the temperature limit switch is to be actuated is set at a low value for safety's sake. This, however, often causes the phenomenom that the temperature limit switch becomes actuated even when there is still so sufficient an amount of refrigerant or lubrication oil in the compressor that the compressor is in an operable state, thus leading to interruption of the operation of the compressor.

OBJECTS OF THE INVENTION

The present invention has been made in order to overcome the above-mentioned drawback in the conventional anti-overheating measures, and it is therefore a primary object of the invention to provide a refrigerant compressor which is provided with a temprature detecting device capable of accurately detecting a change in the temperature in the compressor to assure prevention of seizure of the sliding machine parts of the compressor to be caused by insufficiency of the refrigerant and lubrication oil circulating in the compressor, thereby obtaining a higher rate of operation of the compressor.

It is a further object of the invention to provide a refrigerant compressor which is provided with a temperature detecting device which is excellent in heat resistance and simple in construction and is capable of stably operating even when used in a refrigerant compressor which is usually operated under high temperature conditions.

Other objects and advantages of the invention will be more apparent from the following description with reference to the accompanying drawings.

DETAILED DESCRIPTION OF THE INVENTION

Figure 1:
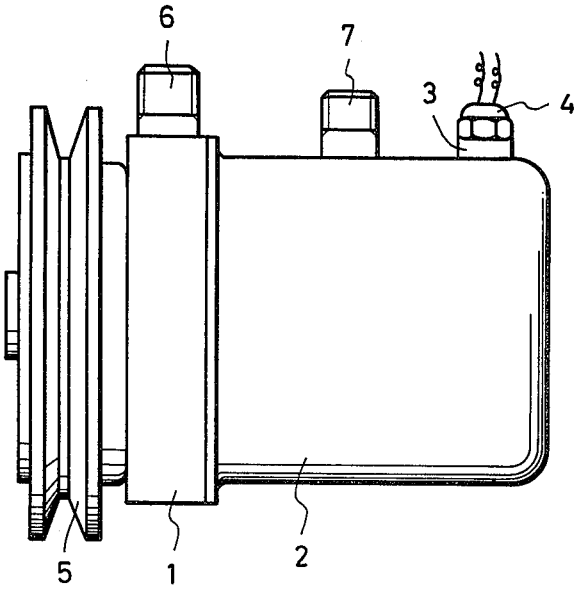
FIG. 1 PRIOR ART
FIG. 1 is a schematic side view illustrating a conventional type refrigerant compressor.

FIG. 1 illustrates a conventional type refrigerant compressor. Reference numeral 1 designates a front head. The front end face of the head 1 is combined with a magnetic clutch 5 which connects together the drive shaft of an associated engine, not illustrated and the rotary shaft, not illustrated, of the compressor. While, the rear end face of the head 1 is combined with a compressor cover 2. An intake port 6 and a delivery port 7 for refrigerant are formed in the outer wall of the front head 1 and that of the cover 2, respectively. Provided in the interior of the cover 2 is a pump housing, not illustrated, which is secured to the front head 1, in such a fashion that a refrigerant delivery chamber, not illustrated, is defined between the outer peripheral wall to the pump housing and the inner peripheral wall of the cover 2. Thus, upon actuation of the pump provided within the compressor, refrigerant and lubrication oil mixed in the refregerant are fed into the compressor through the intake port 6, travel in the pump housing and the delivery chamber within the cover 2, and then are delivered through the delivery port 7 into the refrigerating circuit of an associated air conditioner, not illustrated. A temperature limit switch 4 which is set so as to become actuated at a prescribed temperature is mounted on an oil charge port 3 formed in the outer wall of the cover 2. Prevention of overheating of the refrigerant compressor is attempted by detecting the temperature of the refrigerant in the delivery chamber within the cover 2, by means of said switch 4.

Thus, according to the illustrated arrangement, it is determined, through indirect detection of the temperature of the refrigerant being delivered, whether the compressor is overheated due to insufficiency of the refrigerant and lubrication oil. Thus, it is impossible to accurately ascertain the overheating conditions of the compressor. Therefore, unless the temperature limit switch is preset so as to become actuated at a lower temperature than the critical temperature for safety's sake, the seizure of the sliding machine parts of the compressor due to overheating can not be completely avoided. That is, the temperature of the pump housing increases slowly until just before a critical state (a barely safe state, or a state at a temperature of approximately 150° C. in terms of the temperature of the pump housing wall) is reached, and after that, it suddenly increases. Whilst, the temperature of the refrigerant staying in the delivery chamber for delivery increases slowly in spite of such sudden change in the temperature of the pump housing wall. Thus, it is impossible to detect such sudden increase in the temperature of the pump housing wall which occurs just before the occurrence of seizure of the sliding machine parts of the compressor. For this reason, the operation of the compressor often has to be interrupted even when the refrigerant and lubrication oil staying in the compressor are still sufficient in quantity enough to continue the operation of the compressor.

Figure 2:
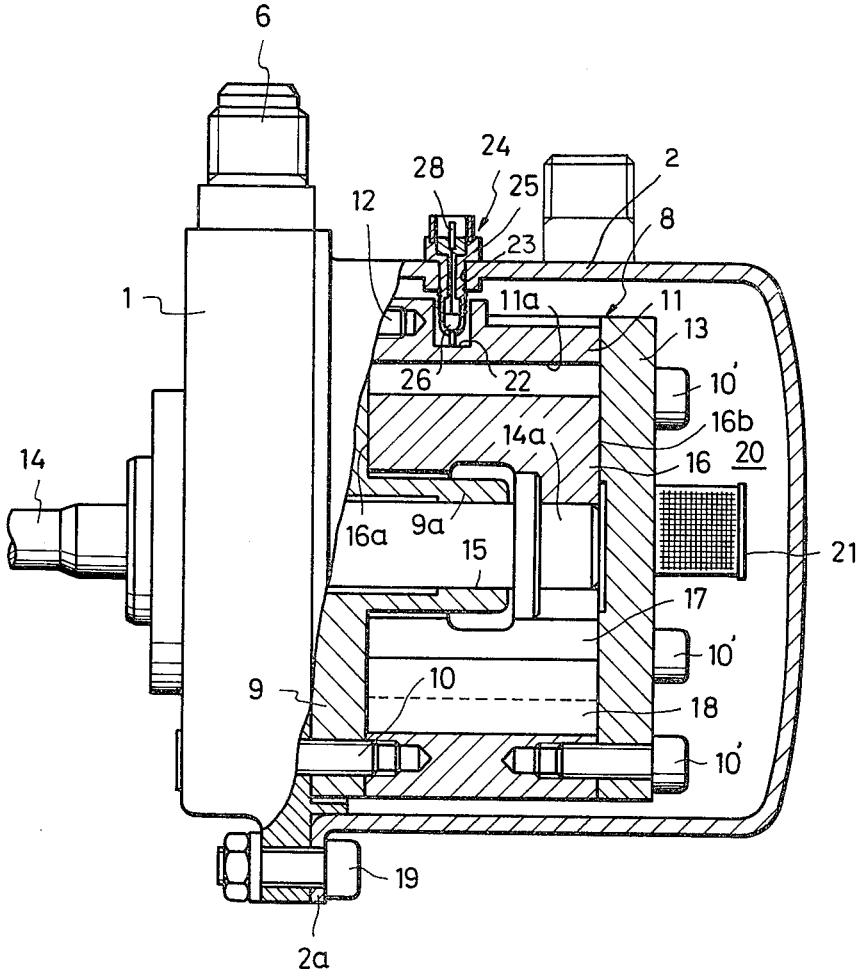
FIG. 2 is a partially sectional side view of the refrigerant compressor according to an embodiment of the invention.

FIG. 2 illustrates an embodiment of the invention. The basic construction of the illustrated compressor is substantially the same as one disclosed in U.S. Pat. No. 3,834,846, hereinbefore referred to. A front head 1 formed with a refrigerant intake port 6 in a lateral peripheral surface thereof, has a rear end face thereof joint to a front block 9 by means of a plurality of bolts 10 (only one of them is shown). A cam ring 11, which has a cylindrical bore of an oblong cross section though not clear from the drawings, has one end thereof secured to the rear end face of the front block 9 by means of said bolts 10 and located in place by a pin 12. A rear block 13 is secured to the other end of the cam ring 11 by means of a plurality of bolts 10' (only one is shown). Thus, the front and rear blocks 9, 13 and the cam ring 11 form a pump housing generally designated by 8. A rotary shaft 14, which is driven by an associated engine, not illustrated, via a magnetic clutch, not illustrated either, penetrates the front head 1 and a through bore 15 formed in the front block 9. The rotary shaft 14 has a rear end portion **14*a* thereof protruding from the front block 9 to which is secured a pump rotor 16. The rotor 16 is supportedly and rotatably fitted over a projecting supporting portion 9*a* of the front block 9, with opposite end faces 16*a*, 16*b* thereof held in airtight contact with the front block 9 and the rear block 13**, respectively.

A plurality of axially extending slits 17 (only one is shown) are formed in the outer peripheral lateral surface of the rotor 16 in relation circumferentially spaced from each other. As many plate-like vanes 18 (only one is shown) are radially movably fitted in these slits 17. With rotation of the rotor 16, these vanes 18 come into permanent sliding contact with the inner peripheral surface of the cam ring 11, due to the centrifugal force acting upon them. Though not clearly shown in the drawing, the rotor 16 has a circular cross section with a diameter as large as the inner diameter of the shorter portion of the cylindrical bore **11*a* of the cam ring 11 so that part of the peripheral lateral surface of the rotor 16 is kept in sliding contact with the inner peripheral surface of the cam ring 11. Thus, spaces are formed between the inner peripheral surfaces of the front block 9, the cam ring 11 and the rear block 13 and the outer peripheral surface of the rotor 16, and said spaces are divided by the vanes 18 into a plurality of pump working chambers, which act as suction chambers and discharge chambers communicating, respectively, with refrigerant inlets and outlets, not illustrated, formed in the cam ring 11**.

The cover 2 has an end flange **2*a* thereof secured to the rear end face of the front head 1 by means of a plurality of bolts 19 (only one is shown) so that the inner peripheral surface of the cover 2 cooperate with the outer peripheral surface of the pump housing 8 to define a refrigerant delivery chamber 20. A gauze member 21 for separation of refrigerant and oil is mounted on the pump housing 8 in a fashion such that it projects into the delivery chamber 20 and encloses an aperture, not illustrated, which is formed in the rear block 13** in communication with the outlets of the pump working chambers.

In the above-mentioned arrangement, when the rotary shaft 14 is rotated, the refrigerant sucked in through the intake port 6 in the front head 1 is guided into the pump working chambers via the above-mentioned inlets by the rotation of the rotor 16. Then, the refrigerant travels through the above-mentioned outlets and the gauze member 21 into the delivery chamber 20, and is delivered into the refrigerating circuit of the air conditioner through the delivery port, not illustrated, formed in the peripheral wall of the cover 2.

Figure 3:
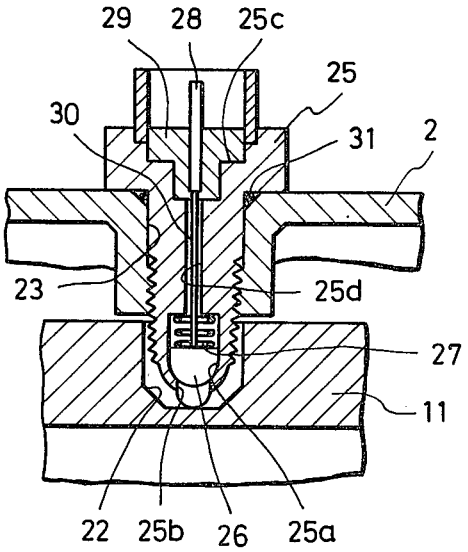
FIG. 3 is an enlarged view of the temperature sensor portion of the refrigerant compressor of FIG. 2.

According to this invention, a groove 22 of a U-shaped section and a through bore 23 are formed in the outer peripheral wall of the cam ring 11 and in the corresponding portion of the cover 2, respectively. A temperature sensor 24 is inserted in the groove 22 through the bore 23. This temperature sensor 24 is illustrated in detail in FIG. 3. A bolt-like support member 25 is threadedly fitted in the through bore 23 with its tip inserted in the groove 22. The tip portion of the support member 25 has its interior formed as a cavity **25*a* in which a thermistor 26 is disposed. The thermistor 26 has its smaller tip portion projected from a small hole 25*b* formed in the tip of the support member 25 by the force of a spring 27 placed within the same cavity 25*a*, so as to be pressed against the bottom surface of the groove 22. The support member 25 has its base end face formed as a concavity 25*c* in which a terminal 28 is disposed. The terminal 28 is immobilized by a resin filler 29 which fills the concave portion 25*c* so as to provide airtight insulation between the inside and the outside of the cover 2. The terminal 28 is connected with the thermistor 26 by a lead wire 30 passing through an axial passage 25*d* formed in the support member 25. Further, the support member 25 is sealed against the cover 2 in an airtight manner by an O-ring 31** fitted thereon.

Next, an example of the circuit for giving an alarm in response to a signal issued by the above-described temperature sensor will be described with reference to FIG. 4.

Figure 4:
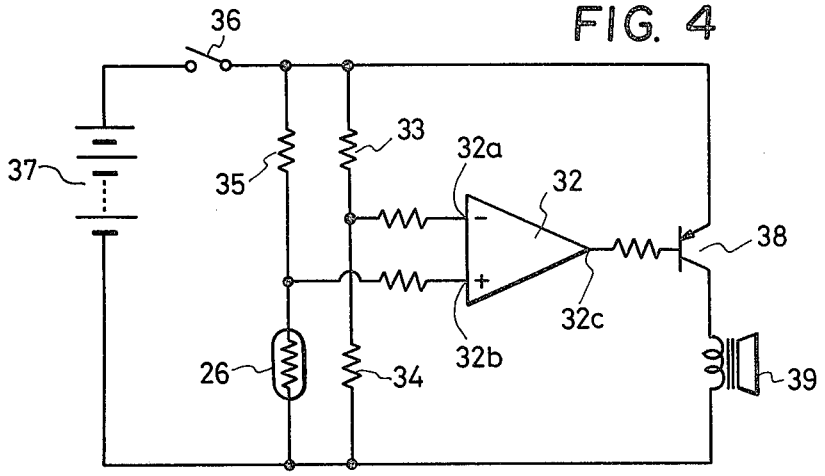
FIG. 4 is a circuit diagram illustrating an example of the alarm circuit adapted for use with the temperature sensor illustrated in FIGS. 2 and 3.

In FIG. 4, an operational amplifier 32 has an inverting input terminal **32*a* connected with a junction of resistances 33 and 34 which form a voltage divider circuit supplying a reference input voltage to the amplifier, and a non-inverting input terminal 32*b*** connected with a junction of a resistance 35 and the thermistor 26 which form a variable voltage circuit, respectively. Thus, a non-inverting amplifier circuit is provided as a whole. Said voltage divider circuit and said variable voltage circuit are connected with a direct current power source 37 via a switch 36 operatively connected to the power switch of an associated air conditioner. The output terminal 32*c* of the operational amplifier 32 is connected with the base of a PNP transistor 38 which has its emitter connected with said switch 36 and its collector with a buzzer 39, respectively.

With this arrangement, if the refrigerant or the lubrication oil circulating in the compressor has decreased in quantity during the operation of the compressor so that the compressor becomes overheated, the thermistor 26 of the temperature sensor 24 has a decreased resistance value due to an increase in the temperature of the cam ring 11 constituting part of the pump housing 8, thus leading to a drop in the input voltage applied to the non-inverting input terminal 32*b* of the operational amplifier 32. A consequent drop in the output voltage from the operational amplifier 32 causes the transistor 38 to be turned on to sound the buzzer 39 as an alarm.

Figure 5:
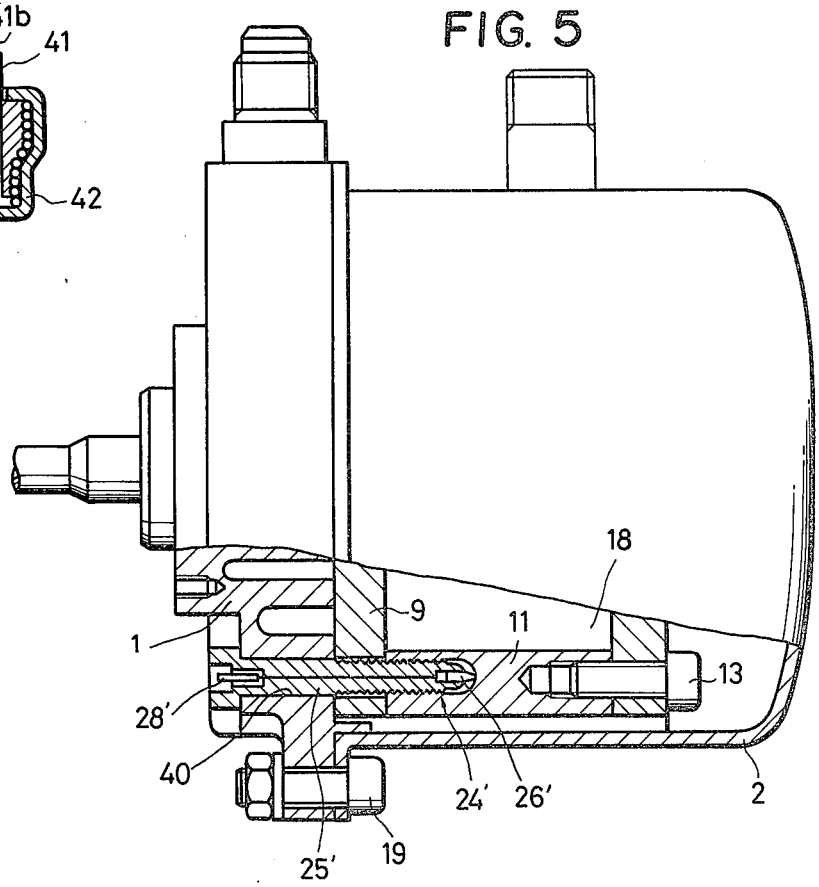
FIG. 5 is a partially sectional side view of the refrigerant compressor according to another embodiment of the invention.

FIG. 5 illustrates another embodiment of the invention. According to this embodiment, a temperature sensor 24' is mounted within one of the holes 40 for receiving the bolts 10 securing the pump housing 8 to the front head 1. Since the basic construction of the temperature sensor 24' is just identical with that illustrated in FIGS. 2 and 3, the corresponding main parts are given identical reference characters but with a suffix', in FIG. 5. A bolt-like support member 25' is inserted in a bolt receiving hole 40 opening in the front end face of the front head 1 and extending through the head 1, the front block 9, and in part of the cam ring 11, for sensing the internal temperature of the cam ring 11 in a similar manner as in the previous embodiment in FIGS. 2 and 3. Thus, similar results to those obtained by the previous embodiment are available. In addition, no airtight sealing member such as O-ring is required according to this embodiment.

In place of the thermistor, other semiconductor thermo-sensitive devices may be used, such as critesistor (Critical Temperature Resistor: CTR) or posistor (Positive Temperature Coefficient thermistor: PTC).

Figure 6:
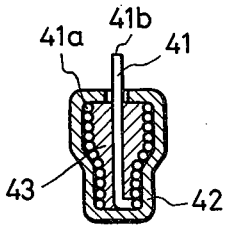
FIG. 6 is a sectional view illustrating another example of the temperature sensor adapted for use in the refrigerant compressor according to the invention.

Another example of the temperature sensor is illustrated in FIG. 6. As illustrated in FIG. 6, a conductor wire 41 made of a metal, which has been coiled after being coated with some insulating material such as enamel paint, is placed within a metal casing 42 having a suitable configuration, with its outer peripheral surface held in contact with the inner surface of the casing 42. The conductor wire 41 has one end 41*a* joint to the metal casing 42, and the other end 41*b* connected with a terminal, not illustrated, leading to an alarm circuit, not illustrated either. A resin 43 is filled in the metal casing 42 for fixing the conductor wire 41.

The resistivity of metals in general has a positive coefficient of temperature. That is, the electric resistance of a metal increases with the increase of the temperature of the metal. Thus, by detecting the resistance value of the metal, it is possible to gather the ambient temperature. Accordingly, if the metal casing 42 in which the metal wire 41 is enclosed is placed in a similar portion of the compressor to those illustrated in FIGS. 2 and 5, the temperature at said portion can be gathered from the change in the electric current flowing in the metal wire 41. As the material for the conductor wire 41, copper, aluminum, iron, and other like metals are suitable. Also, a wire made of a high resistance material such as nichrome may be used. The thickness and length of the conductor wire may be selected at suitable values with reference to the material used for the wire and the circuit constant of the alarm circuit used in combination with the temperature sensor.

During the operation of the compressor, the pump housing temperature usually increases up to 120° C.-130° C. with the increase of the heat load. Said temperature even exceeds 150° C. when the pump housing comes into an overheated state due to the insufficiency of the refrigerant and lubrication oil, in which the sliding machine parts in the housing undergo seizure. Under such circumstances, if a temperature sensor employing a thermistor is used, the thermistor is subject to a high temperature in the vicinity of the breaking temperature of the semiconductor. Such severe working conditions may sometimes render unstable the operation of the thermistor. Whilst, the above-mentioned manner of detecting the pump housing temperature with reference to the resistance change of the conductor wire makes it possible to detect the temperature increase more steadily than in the case of using a thermistor, since the conductor wire has a very high melting point, for instance 1083° C. in a conductor wire made of copper.

As set forth above, according to the present invention, it is feasible to prevent the sliding machine parts of the compressor from undergoing seizure due to the insufficiency of the refrigerant and lubrication oil by providing the arrangement in which the pump housing temperature is detected in a direct manner, thereby to obtain an enhanced rate of operation of the compressor.

It is to be understood that the foregoing description relates to preferred embodiments of the invention and that various changes and modifications may be made in the invention without departing from the spirit and scope thereof.

What is claimed is:

1. A refrigerant compressor for use in an air conditioner for vehicles, which comprises:

a refrigerant intake port;

a refrigerant delivery port;

a rotary shaft arranged to be rotated by an associated engine;

a rotor secured to said rotary shaft for rotation therewith, the rotor having a plurality of slits formed in an outer peripheral surface thereof;

a plurality of vanes radially movably inserted in said slits;

a housing accommodating said rotor and said vanes, the rotor, the vanes and the housing cooperating to define pump working chambers between them, the housing having a peripheral wall formed with a blind hole opening in an outer peripheral surface thereof and terminating in the interior of said wall;

a covering enclosing said housing, the covering having an inner peripheral wall thereof, part of said inner peripheral wall cooperating with an outer peripheral wall of said housing to define a refrigerant delivery chamber which is in communication with both the interior of the housing and said refrigerant delivery port, said covering having a through hole arranged in alignment with said opening;

a support member inserted in said hole of said housing, said support member extending through said through hole of said covering outwardly thereof;

a temperature sensor arranged in contact with the bottom of said hole of said housing and supported by said support member; and sealing means provided around the support member for keeping airtightness between said support member and said covering.

2. The refrigerant compressor as recited in claim 1, wherein said temperature sensor is pressed against the bottom of said hole of said housing; and wherein said sealing means comprises an annular sealing member interposed between said support member and said through bore.

3. The refrigerant compressor as recited in claim 1, including a front head which forms part of said covering, said front head being formed with said refrigerant intake port in a peripheral wall thereof; and a plurality of blind holes for receiving bolts, extending through said front head and in part of said housing; said support member being fitted in one of said blind holes; said temperature sensor being pressed against a bottom surface of said one of said blind holes; and said sealing means is formed of part of said housing.

4. The refrigerant compressor as recited in any one of claims 1, 2 or 3, in which said temperature sensor comprises a semiconductor thermo-sensitive device.

5. The refrigerant compressor as recited in claim 4, in which said semiconductor thermo-sensitive device is a thermistor.

6. The refrigerant compressor as recited in any one of claims 1, 2 or 3, in which said temperature sensor comprises a metal wire in the form of a coil.

7. The refrigerant compressor as recited in claim 6, in which said coiled metal wire is made of a high resistance metal.

8. The refrigerant compressor as recited in claim 2 in which said annular sealing member comprises an O-ring, and said sealing means further comprises a resin filler sealing said temperature sensor in said support member.

9. The refrigerant compressor as recited in claim 1 or 2 comprising a further sealing means sealing said temperature sensor in said support means.

10. The refrigerant compressor as recited in claim 9 wherein said further sealing means comprises a resin filler.

11. A refrigerant compressor for use in an air-conditioner for vehicles, which comprises:

a refrigerant intake port;

a refrigerant delivery port;

a rotary shaft arranged to be rotated by an associated engine;

a rotor secured to said rotary shaft for rotation therewith, the rotor having a plurality of slits formed in an outer peripheral surface thereof;

a plurality of vanes radially movably inserted in said slits;

a housing accommodating said rotor and said vanes, the rotor, the vanes and the housing cooperating to define pump working chambers between them, the housing having a peripheral wall formed with a blind hole opening in an outer peripheral surface thereof and terminating in the interior of said wall;

a covering enclosing said housing, the covering having an inner peripheral wall thereof, part of said inner peripheral wall cooperating with an outer peripheral wall of said housing to define a refrigerant delivery chamber which is in communication with both the interior of the housing and said refrigerant delivery port, said covering having a through hole arranged in alignment with said opening;

a support member inserted in said hole of said housing, said support member extending through said through hole of said covering outwardly thereof;

a temperature sensor comprising a metal wire arranged in contact with the bottom of said hole of said housing and supported by said support member; and sealing means provided around the support member for keeping airtightness between said support member and said covering.

12. The refrigerant compressor as recited in claim 11 in which said temperature sensor comprises a metal wire in the form of a coil.

13. The refrigerant compressor as recited in claim 12, in which said coiled metal wire is made of a high resistance metal.

* * * * *